US008136534B2

(12) United States Patent
D'Assis et al.

(10) Patent No.: US 8,136,534 B2
(45) Date of Patent: Mar. 20, 2012

(54) METHOD AND DEVICE FOR ENCLOSING HAIR

(76) Inventors: Andrea D'Assis, Corona, CA (US); Dale Anderson, Corona, CA (US)

( * ) Notice: Subject to any disclaimer, the term of this patent is extended or adjusted under 35 U.S.C. 154(b) by 266 days.

(21) Appl. No.: 12/413,188

(22) Filed: Mar. 27, 2009

(65) Prior Publication Data

US 2010/0242980 A1 Sep. 30, 2010

(51) Int. Cl.
*A41G 5/00* (2006.01)

(52) U.S. Cl. ..... 132/56; 132/200

(58) Field of Classification Search ..... 132/273, 132/274, 275, 222, 270; 119/850, 809; 54/78
See application file for complete search history.

(56) References Cited

U.S. PATENT DOCUMENTS

| | | | | | |
|---|---|---|---|---|---|
| 5,303,723 | A | | 4/1994 | Schach | |
| 5,440,774 | A | * | 8/1995 | Cole | 15/105 |
| 5,472,003 | A | * | 12/1995 | Frame et al. | 132/275 |
| 5,727,575 | A | | 3/1998 | Rontal | |
| 5,826,593 | A | * | 10/1998 | Haubrich | 132/128 |
| 6,009,882 | A | | 1/2000 | Schine et al. | |
| 6,260,559 | B1 | | 7/2001 | Schirren et al. | |
| 6,276,369 | B1 | * | 8/2001 | Rogers | 132/273 |
| 6,435,194 | B1 | | 8/2002 | Babay | |
| 7,252,092 | B2 | | 8/2007 | Kelsey | |
| 7,293,566 | B2 | * | 11/2007 | Thall | 132/274 |
| 7,305,995 | B2 | * | 12/2007 | Tojo et al. | 132/222 |
| 2005/0066415 | A1 | | 3/2005 | Adkins | |
| 2005/0229944 | A1 | * | 10/2005 | Pena | 132/273 |
| 2005/0247327 | A1 | * | 11/2005 | Ison | 132/274 |
| 2006/0157078 | A1 | * | 7/2006 | Tojo et al. | 132/222 |
| 2007/0215171 | A1 | * | 9/2007 | Imazu | 132/274 |
| 2008/0109938 | A1 | | 5/2008 | Douglas | |
| 2008/0149130 | A1 | | 6/2008 | Brown | |

OTHER PUBLICATIONS

Hair Glove Cycle, Motorcycle and Leather Hairwear and Accessories, website http://www.hairgolvecycle.com/ExtendedProducts.asp.

* cited by examiner

*Primary Examiner* — Todd Manahan
*Assistant Examiner* — Brianne Kalach
(74) *Attorney, Agent, or Firm* — Kirk A. Buhler; Buhler & Associates

(57) ABSTRACT

A method and device for enclosing a portion of hair such that it is not mussed or damaged, yet is aesthetically pleasing. A flexible and elastic elongated material having a cavity therein receives the hair, and the device is unfurled to a desired length.

5 Claims, 5 Drawing Sheets

METHOD AND DEVICE FOR ENCLOSING HAIR

FIELD OF THE INVENTION

The invention relates to a device and method for enclosing and maintaining hair; more specifically, a device and method are provided to hold and adorn a portion of a user's hair, e.g. a pony tail, a braided pony tail, or pigtail hairstyles, such that the hair will not be mussed.

BACKGROUND

Devices for forming and maintaining hairstyles have existed for a long time. For example, hairpins have been used to secure strands of hair to create a desired configuration. Other clamping devices have also been introduced to maintain hair in a desired configuration.

Long hair can be formed into a variety of styles depending upon the desires of the particular individual. Thus, the hair can be placed into a bun or buns, ponytail, French knot, braid, cascade, and a variety of other shapes by the use of hairstyling devices.

The concern is that the hairstyling devices themselves are often unattractive, detracting from the overall appearance of the hairstyle. For example, standard bobby pins may reduce the attractiveness of a hairstyle.

Also, such bobby pins, barrettes, and the like, tend not only to be unsightly but also to damage the hair during repeated use or may fail in high winds or during physical activities. In addition, they do not prevent mussing during such physical activities or turbulent climate conditions. As a result, a user's hair becomes tangled or even damaged.

Hairnets have also been used to hold a user's hair in place. Hairnets, however, are aesthetically unappealing and the pressure causes the hair onto the scalp, thereby resulting in disheveled hair after its removal.

Often, a person will wish to include an ornamental object, e.g. a bow, or an alternate form of individual expression, e.g. a written message or artwork, with a particular hairstyle. The ornamental objects may be difficult to maintain over time and may become damaged in high wind conditions. Further, the forms of individual expression are limited because of the shape of the clamping device.

There has not been a development in the art of maintaining hair styles, while at the same time minimizing damage to the hair through a clamping device or entanglement thereof during rigorous exercise or turbulent climate conditions. Thus, there remains a need to provide a hairstyle maintaining device for holding long hair in place while simultaneously giving color, style, fashion and personality to one's overall appearance. Also, it is desirable to provide a hair maintaining device that can be easily put on by a user without another's assistance. Additionally, it is desirable to provide a pony tail holder which is easy and economical to manufacture and use.

SUMMARY OF PREFERRED EMBODIMENT(S)

Accordingly, it is a general object of the present invention to overcome the disadvantages of existing devices.

Therefore, it is a primary objective of the invention to provide a hairstyling and maintaining device that is easy to use, yet very fashionable.

It is another objective of the invention to provide a cost-efficient hairstyling and maintaining device in use and manufacture.

It is another objective of the invention to provide a hairstyling device that prevents the hair from being mussed or entangled during physical activity and in windy conditions.

It is yet another objective of the invention to provide a hair maintaining device that prevents the hair from obstructing a user's view.

It is yet another objective of the invention to easily enclose a user's ponytail to prevent dirt from being lodged therein.

It is a further objective of the invention to enclose ponytails of differing lengths and thicknesses.

In keeping with the principles of the preferred embodiments, a unique hairstyling and maintenance device is disclosed herein. The hairstyling and maintenance device is easy to manufacture and use, where an individual can easily apply it to his or her own hair without any assistance. The hairstyling and maintenance device can also be adorned with aesthetic forms of expression.

Such stated objects and advantages of the preferred embodiment or embodiments are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the preferred embodiments. In the drawings, wherein similar reference characters denote similar elements throughout the several views.

DETAILED DESCRIPTION OF THE INVENTION

Figure 1:
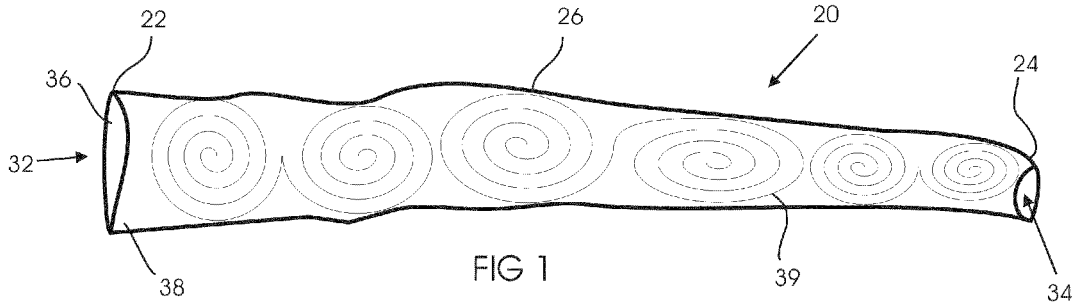
FIG. 1 is a side perspective view of a preferred embodiment of a hair device in an unfurled state.

Referring now to FIGS. 1 through 9, a hair maintenance and styling device 20 is illustrated having a first end 22 and a second end 24 which are located at distal ends of a body 26. In a preferred embodiment, the device 20 is constructed of elastic material or shape memory fabric which, for purposes of illustration but not limitation, may be selected from fabric of 100% polyester (e.g. crushed panne velour), 90% polyester and 10% spandex, 88% nylon and 12% spandex, or 94% cotton and 6% spandex.

Referring now to particularly to FIGS. 1, 3, 4 and 5, in one preferred embodiment, body 26 is formed from a piece of fabric having a substantially isosceles trapezoid shape having a left side 28 and a right side 30. Left side 28 and right side 30 are brought into close proximity with one another and, in one preferred embodiment, are attached or sewn together along the length thereof. As a result, a first opening 32 is defined by first end 22 and a second opening 34 is defined by second end 24. An inner surface 36 and outer surface 38 are defined on body 26, such that inner surface 36 defines a cavity 40 running along the length of body 26. Outer surface 38 can accommodate indicia 39 of a user's preference.

In one preferred embodiment, the piece of fabric is approximately seventeen inches long, first end 22 is approximately four inches wide, and second end 24 is approximately two inches wide. It is to be understood that the dimensions provided herein are for purposes of illustration only and not limitation. To that end, it is possible for the length of the fabric to be as short as one and a half inches on the short end, and not have a particular restriction on the long end and can be of a sufficient length predetermined by the user.

Figure 2:
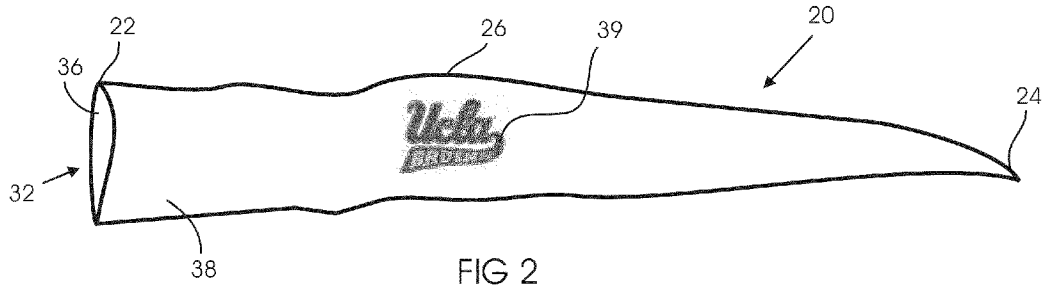
FIG. 2 is a side perspective view of an alternate preferred embodiment of the hair device in an unfurled state.
Figure 3:
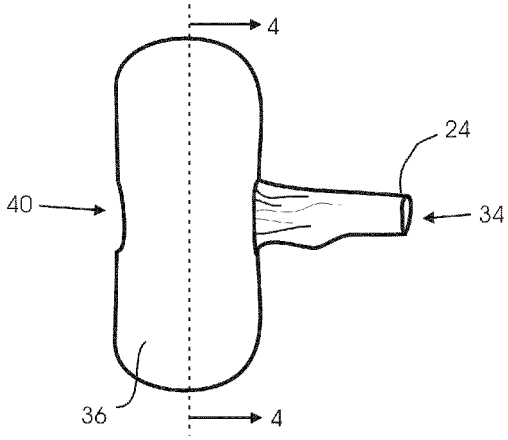
FIG. 3 is a side perspective view of the hair device in a rolled up state.

Referring now particularly to FIG. 2, an alternate preferred embodiment is therein illustrated where second end 24 is of a predetermined narrow width such that the attachment or stitching which joins the left and right sides 28 and 30 causes a closed second end 24, yet leaves first opening 32 at first end 22.

In both preferred embodiments, the stitching or attachment (e.g. adhesive) of the left and right sides 28 and 30 is formed inwardly from the inner surface 36, such that a resulting seam 42 is not observable when the device 20 is worn. It should be noted, however, that in yet another preferred embodiment, the device 20 may be formed to define cavity 40 in a seamless manner as is known in the art; for example, by circular knitting processes which can also be carried out by commercially available equipment, such as a SANTONI SM8 knitting machine.

Figure 7:
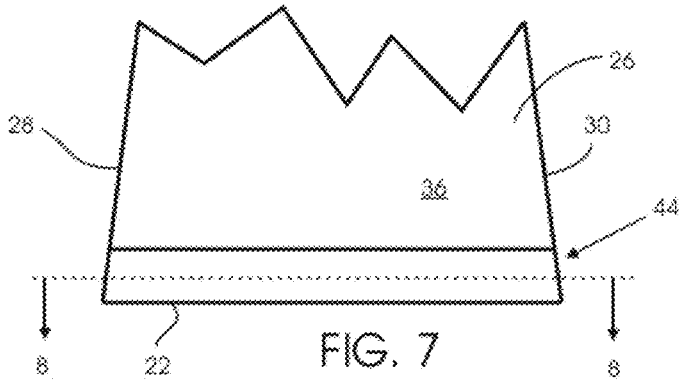
FIG. 7 is a partial plan view of an alternate preferred embodiment of the device in an unassembled state.
Figure 8:
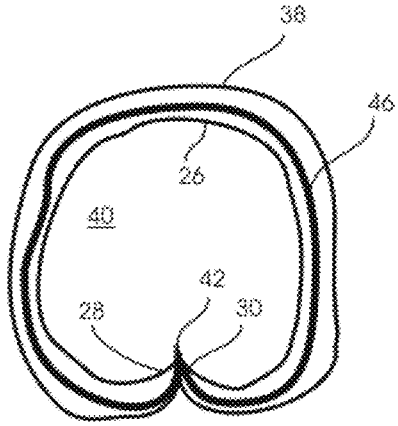
FIG. 8 is a cross-sectional view of the device in an assembled state taken along line 8-8 of FIG. 7.
Figure 9:
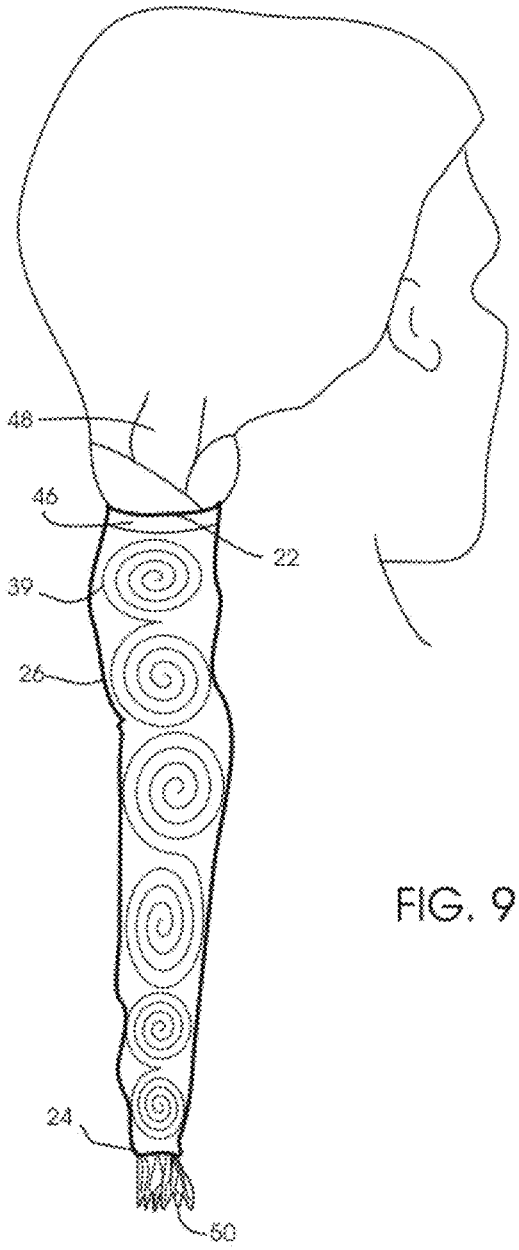
FIG. 9 is a perspective view of an alternate preferred embodiment of the device being applied to a portion of hair of a user.

Now referring particularly to FIGS. 7, 8 and 9, an alternate preferred embodiment is illustrated wherein first end 22 is partially folded over and attached such that an aperture 44 is formed and traverses from left side 28 to right side 30. Aperture 44 receives an elastic element 46 therein, which also traverses from left side 28 to right side 30.

Figure 4:
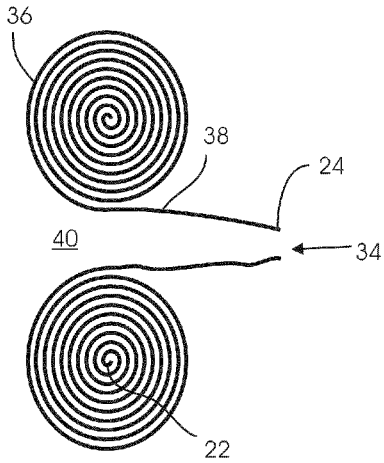
FIG. 4 is a cross-sectional view of the hair device taken along line 4-4 of FIG. 3.
Figure 5:
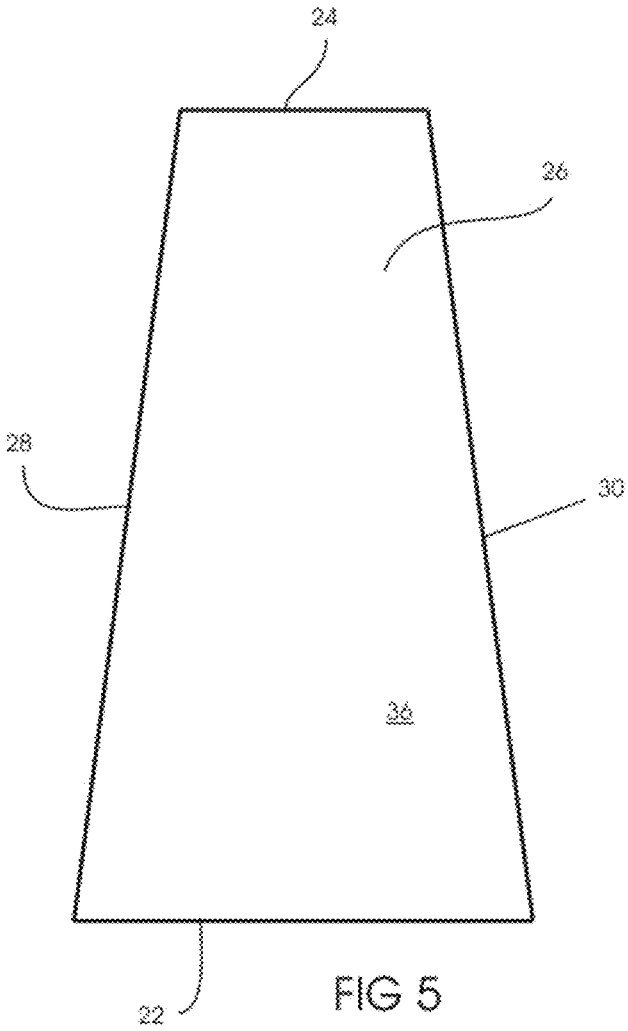
FIG. 5 is a plain view of the hair device in an unassembled state.
Figure 6:
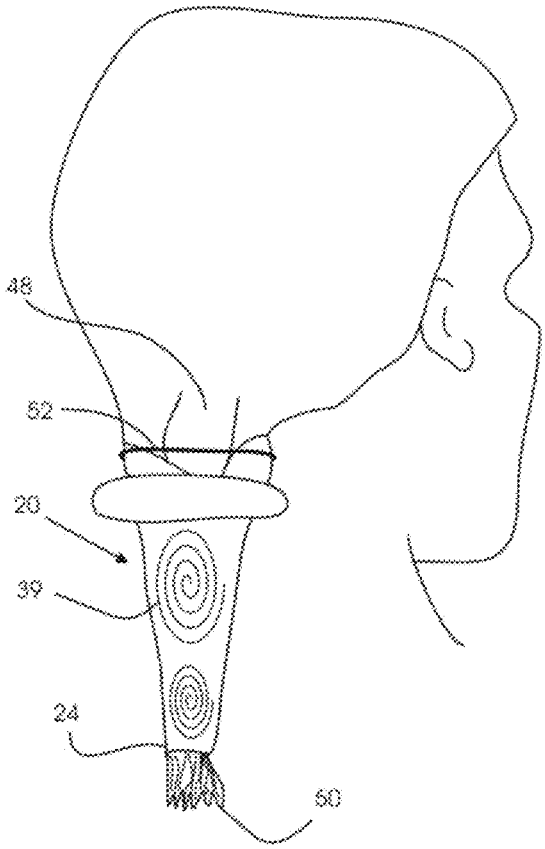
FIG. 6 is a perspective view of the device being applied to a portion of hair of a user.

In order to apply the device 20 to a portion of hair 48, device 20 is initially furled as illustrated in FIG. 4. A leading end 50 of a portion of hair 48, which may be braided, is inserted into cavity 40 and is proximal to second end 24. Device 20 is then unfurled such that first end 22 it is proximal to the root of a user's hair 48. In the preferred embodiment where elastic element 46 is integrated, elastic element 46 provides additional pressure on the hair 48, which is especially desired during strenuous physical activities (e.g. basketball, soccer, volleyball, etc.) or high wind conditions (e.g. inclement weather, riding motorcycles, etc.). In the alternate preferred embodiment, device 20 may omit the elastic element 46 and if a user desires additional security, an elastic band 52 may first be applied to hair 48, and device 20 unfurled over the same.

In yet another preferred embodiment, a second elastic band may be applied on top of the unfurled device 20—proximal to first end 22—to further secure the same and prevent loss thereof in extreme wind conditions, for example when skydiving.

While the above description contains many specificities, these should not be construed as limitations on the scope of the invention, but rather as an exemplification of preferred embodiments thereof. Many other variations are possible without departing from the essential spirit of the preferred embodiments of this invention. Accordingly, the scope of the invention should be determined not by the preferred embodiments illustrated, but by the claims and their legal equivalents.

What is claimed is:

1. A method of enclosing hair, comprising the chronological steps of:

1) providing a resilient elongated tapered body having a cavity defined therein and a first opening defined at a first end and a second tapered end that is at an extreme opposite end of said resilient body;
2) furling said elongated body;
3) inserting a portion of hair through said first opening and into said cavity so that free ends of the hair extend toward the second end of the tapered body;
4) unfurling said elongated body along the length of the hair towards roots of the hair such that said first end is proximal to roots of the hair.

2. The method of claim 1, further including applying an elastic band proximal to roots of the hair and unfurling said first end over said elastic band.

3. The method of claim 1, further including enclosing an elastic element within said first end.

4. The method of claim 1, further including applying indicia to an outer surface of said body.

5. The method of claim 1, further including forming a second opening defined by said second end.

* * * * *